US006085651A

United States Patent [19]

Defrance et al.

[11] Patent Number: 6,085,651

[45] Date of Patent: Jul. 11, 2000

[54] ECCENTRIC DEVICE FOR ADJUSTING PRINTING UNIT CYLINDERS INCLUDING A CYLINDER SUPPORT WITH A STOP FACE

[75] Inventors: Serge Defrance, St. Just en Chaussee; Franck Roland, Chantilly, both of France

[73] Assignee: Heidelberger Druckmaschinen Aktiengesellschaft, Heidelberg, Germany

[21] Appl. No.: 09/311,117

[22] Filed: May 13, 1999

[30] Foreign Application Priority Data

May 13, 1998 [FR] France ..... 98 06017

[51] Int. Cl.[7] ..... B41F 13/36

[52] U.S. Cl. ..... 101/247; 101/182; 101/184

[58] Field of Search ..... 101/283, 248, 101/485, 218, 247, 216, 217, 182, 184

[56] References Cited

U.S. PATENT DOCUMENTS

| | | | |
|---|---|---|---|
| 4,458,590 | 7/1984 | Egnaczak et al. | 101/247 |
| 4,643,090 | 2/1987 | McKrell et al. | 101/218 |
| 5,301,609 | 4/1994 | Guaraldi et al. | 101/216 |
| 5,678,485 | 10/1997 | Guaraldi | 101/247 |
| 5,771,804 | 6/1998 | Knauer et al. | 101/183 |
| 5,813,336 | 9/1998 | Guaraldi et al. | 101/218 |
| 5,875,714 | 5/1999 | Winkler et al. | 101/216 |

*Primary Examiner*—John S. Hilten
*Assistant Examiner*—Daniel J. Colilla
*Attorney, Agent, or Firm*—Herbert L. Lerner; Laurence A. Greenberg; Werner H. Stemer

[57] ABSTRACT

A device for engaging and disengaging or throwing-off printing unit cylinders in a printing entity of a rotary printing press for printing a web of material, the printing entity including a lower and an upper printing unit, and one of the printing unit cylinders having a stationary mounting support in one of the printing units of the rotary printing press, includes a first adjusting unit for adjusting printing unit cylinders of the printing entity which are formed as printing form cylinders, and a second and eccentric adjusting unit for adjusting one of two of the printing unit cylinders of the printing entity which are formed as transfer cylinders, so that the printing unit cylinders of each of the lower and the upper printing units, respectively, are in mutual engagement, while the transfer cylinders of the respective lower and upper printing units are disengaged from one another.

14 Claims, 3 Drawing Sheets

ECCENTRIC DEVICE FOR ADJUSTING PRINTING UNIT CYLINDERS INCLUDING A CYLINDER SUPPORT WITH A STOP FACE

BACKGROUND OF THE INVENTION

Field of the Invention

The invention relates to a device for adjusting, for example, engaging and disengaging or throwing off printing unit cylinders in rotary printing presses, especially for web-fed rotary printing presses.

The published European Patent Document EP 0 193 012 A2 relates to a rotary printing press with a device for adjusting printing unit cylinders between one position, in which bearer rings of the printing unit cylinders are disengaged or thrown off from one another, and another position in which the cylinders are positioned against or engaged with one another during a printing operation. The printing unit cylinders, in the disengaged or thrown-off position thereof, are subjected to force by springs which, in one embodiment described in this reference, exert a force on rotatably supported retaining or holding arms of the printing unit cylinders. In another embodiment of the invention defined in the aforementioned published European Patent Document EP 0 193 012 A2, the printing unit cylinders are supported on leaf spring-shaped elements which force the cylinders into the disengaged or thrown-off position thereof. A motor is provided that exerts a force directly on one of the cylinders in order to bring it out of the disengaged or thrown-off position thereof and place it in the engaged position thereof that is required for the printing operation. The other printing unit cylinders are moved out of the respective disengaged or thrown-off positions thereof and into the engaged position thereof during the printing mode, by forces which are transmitted via bearer or Schmitz rings connected to the printing unit cylinders.

The published European Patent Document EP 0 625 423 A1 discloses a printing unit having a skewing engagement and disengagement device. The printing unit includes a frame, a first and a second support bracket, and a lower and an upper plate cylinder. The first support bracket is movably mounted on the frame. One end of the upper plate cylinder is mounted so that it moves with the first support bracket. The second support bracket is also movably mounted on the frame. One end of the lower printing unit cylinder is supported so that it moves with the second support bracket. The printing unit also includes a skewing engagement and disengagement device. The engagement device moves the support brackets transversely to the frame, independently of one another. The engagement device swivels the support brackets with respect to the frame. The engagement device includes a control cylinder and a piston rod, which are provided between the two support brackets. The control cylinder and the piston rod are pivotally connected to the support bracket and are pivotable relative to this support bracket when the latter is adjusted transversely by the skewing engagement device. Via the disengagement or throw-off device, the support brackets can be skewed independently of one another, while nevertheless remaining connected to one another for the disengagement or throw-off operation.

In this embodiment, when the upper and the lower plate cylinder and the rubber blanket cylinder, respectively, are brought into engagement, the rubber blanket cylinders automatically engage with one another as well. This compulsory coupling of the rubber blanket cylinder engagement makes automating of the changing of printing forms considerably more difficult. The web of material remaining between the rubber blanket cylinders in the printing unit can tear when the printing forms are changed, which requires complicated re-threading of the web of material into the printing units, and consequently involves a considerable loss of time.

A remedy can indeed be provided by removing the lower rubber blanket and the lower rubber blanket sleeve, respectively, from the lower printing unit cylinder, so that the printing form on the upper plate cylinder can be replaced, and the reverse thereof, but this is a time-consuming way to maintain a gap within which the web of material can remain during the changing of printing forms in the printing unit.

SUMMARY OF THE INVENTION

It is accordingly an object of the invention to provide a device for adjusting printing unit cylinders in printing units of web-fed rotary printing presses, by which the printing unit cylinders in an upper and a lower printing unit are brought into engagement, yet jacket surfaces of transfer cylinders of the printing units do not engage.

With the foregoing and other objects in view, there is provided, in accordance with the invention, a device for engaging and disengaging printing unit cylinders in a printing entity of a rotary printing press for printing a web of material, the printing entity including a lower and an upper printing unit, and one of the printing unit cylinders having a stationary mounting support in one of the printing units of the rotary printing press, comprising a first adjusting unit for adjusting printing unit cylinders of the printing entity which are formed as printing form cylinders, and a second and eccentric adjusting unit for adjusting one of two of the printing unit cylinders of the printing entity which are formed as transfer cylinders, so that the printing unit cylinders of each of the lower and the upper printing units, respectively, are in mutual engagement, while the transfer cylinders of the respective lower and upper printing units are disengaged from one another.

In accordance with another feature of the invention, the one printing unit cylinder having the stationary mounting support is the transfer cylinder in the lower printing unit.

In accordance with a further feature of the invention, the printing form cylinders of the upper and the lower printing units, respectively, are movable by the first adjusting unit away from the transfer cylinders of the printing units into a position wherein they are disengaged from one another.

In accordance with an added feature of the invention, the device of the invention includes a pressure medium for acting upon the first adjusting unit.

In accordance with an additional feature of the invention, the pressure medium is compressed air.

In accordance with an alternative feature of the invention, the pressure medium is hydraulic fluid.

In accordance with yet another feature of the invention, the device of the invention includes an electric motor for actuating the first adjusting unit.

In accordance with yet a further feature of the invention, the one printing unit cylinder having the stationary mounting support is one of the transfer cylinders, and the other of the two transfer cylinders is disengageable by the eccentric adjusting unit from the stationarily supported transfer cylinder so as to form a through opening therebetween.

In accordance with yet an added feature of the invention, the eccentric adjusting unit includes an adjusting member actuatable via a transmission member by a control unit.

In accordance with yet an additional feature of the invention, the control unit has a thrust member carried by a side wall of the printing entity.

In accordance with still another feature of the invention, the adjusting member is active against a stop face of a cylinder support.

In accordance with still a further feature of the invention, the control unit is responsive to a force pneumatically actionable thereon.

In accordance with an alternative feature of the invention, the control unit is responsive to a force hydraulically actionable thereon.

In accordance with still an added feature of the invention, the device of the invention includes respective replaceable tubular rubber blanket sleeves provided on the transfer cylinders.

In accordance with still an additional feature of the invention, an operating-side bearing support for the transfer cylinders is pivotable about a pivot axis for providing accessibility laterally to the transfer cylinders.

In accordance with another feature of the invention, the device of the invention includes an additional holding unit assigned to the disengageable transfer cylinder for holding the latter in a disengaged position when a gate associated therewith is pivoted out of the way.

In accordance with a concomitant feature of the invention, the first adjusting unit of the printing form cylinders, and the eccentric adjusting unit of the one transfer cylinder are conjointly actuatable.

The advantages of the device according to the invention reside in a simple and reliably controllable disengagement or throw-off of the printing form cylinders from one another; in particular, the fact that the web of material to be printed can remain in a gap between the respective transfer cylinders of the printing units is appropriately taken into account. To achieve a smoothing action during the change of printing forms, it is possible, by suitably employing the device according to the invention, to bring the two printing unit cylinders, i.e., the rubber blanket and the printing form or plate cylinders, into mutual engagement in both the upper and the lower printing unit, respectively, without having to fear any tearing of the web. The through opening for the passage of the web of material through a printing entity is maintained.

In a further feature of the constructive concept fundamental to the invention, the lower one of the transfer cylinders in the printing entity is stationarily supported. This configuration was selected for ergonomic reasons. The adjusting unit disengages or throws-off the printing form or plate cylinders of the printing units from the appertaining transfer cylinders of the printing units, thereby gaining space for a subsequent adjustment of one of the transfer cylinders. The adjusting unit for disengaging or throwing-off the printing form or plate cylinder is subjectible to the action of a pressure medium, such as compressed air or hydraulic fluid. The adjusting unit may, however, also be actuated electromotively.

The adjustable transfer cylinder may be disengaged or thrown-off by a separate eccentric adjusting unit from the transfer cylinder that is stationarily supported, so as to form a through opening for the web of material. To enlarge the opening for the web of material that is formed by the adjusting motion, an eccentric member is rotated by a transmission lever, due to which, as a consequence of the eccentric bearing support of the eccentric member, the disengagement or throw-off of the disengageable transfer cylinder from the transfer cylinder that is stationarily supported takes place. A thrust member or abutment of the adjusting unit can be provided on a side wall of the printing entity. The adjusting member, i.e., the eccentric member, can act upon a stop face of a cylinder support which, for example, has been hardened beforehand or can be made from an especially wear-resistant material. The adjusting unit itself can be acted upon either pneumatically or hydraulically.

In a further refinement of the concept fundamental to the invention, the disengageable transfer cylinder, i.e., the transfer cylinder that is movable out of position, has an additional holding or restraint unit assigned thereto which, when a gate associated therewith is pivoted out of the way, keeps this transfer cylinder in a disengaged or thrown-off position.

Other features which are considered as characteristic for the invention are set forth in the appended claims.

Although the invention is illustrated and described herein as embodied in a device for adjusting printing unit cylinders in printing units of rotary printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
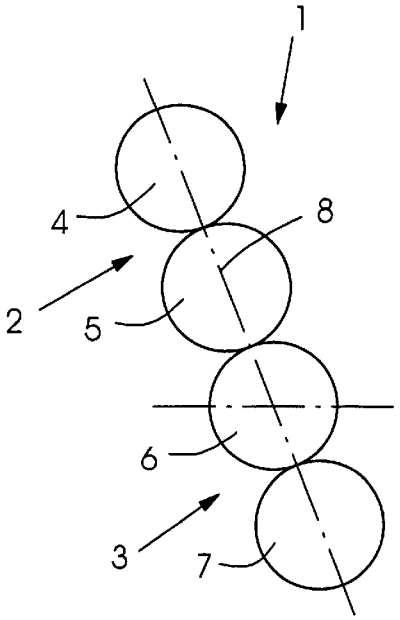
FIG. 1 is a diagrammatic side elevational view of a configuration of printing unit cylinders in an operating phase wherein the cylinders are engaged with one another.

Referring now to the drawings and, first, particularly to FIG. 1 thereof, there is shown therein, in a greatly simplified view, a configuration of cylinders in an operating phase wherein the cylinders are engaged with one another.

A printing entity or assembly 1, shown as a double printing unit, can be subdivided into an upper printing unit 2 and a lower printing unit 3. The upper printing unit 2 includes an upper printing form or plate cylinder 4 and an upper transfer cylinder 5, namely, a rubber blanket cylinder. Likewise, the lower printing unit 3 has a lower transfer cylinder 6, also a rubber blanket cylinder, associated with a lower printing form 5 or plate cylinder 7. The printing form or plate cylinders 4 and 7 are surmounted by printing forms or printing plates, which are inked by otherwise non-illustrated inking units, and transfer an image to be printed to the respective transfer cylinders 5 and 6, from which the image is printed on both sides of a web of material in a conventional manner for double printing units. The printed inks may be classic or conventional heatset inks, however, water-based inks can be printed with short inking units, and printing can be performed by the dry offset process, without any admixture of dampening medium.

Figure 2:
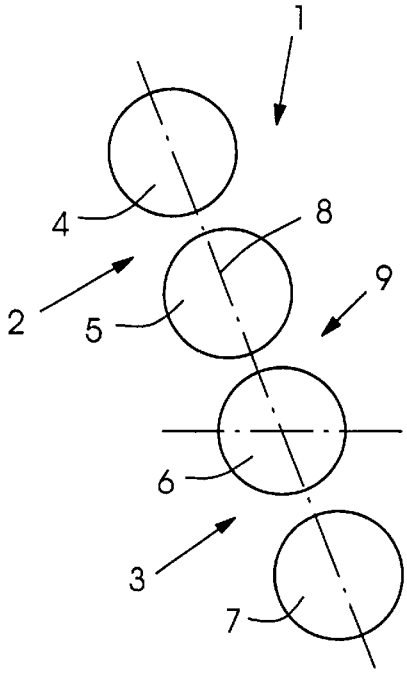
FIG. 2 is a view like that of FIG. 1 wherein the printing unit cylinders are disengaged or thrown off uniformly from one another.

FIG. 2 shows a cylinder configuration with the printing unit cylinders 4 to 7 uniformly disengaged or thrown-off from one another. In this configuration, all the printing unit cylinders 4 to 7 are disengaged equal distances from one another. For certain requirements, such as automated changing of printing forms, for example, it may be necessary to position the printing unit cylinders of the upper and the lower printing units 2 and 3, respectively, pairwise into engagement with one another (note FIG. 3), but a gap should be maintained between the two transfer cylinders 5 and 6, the web path 9 of the web of material remaining extended through the gap located between the printing units 2 and 3.

Figure 3:
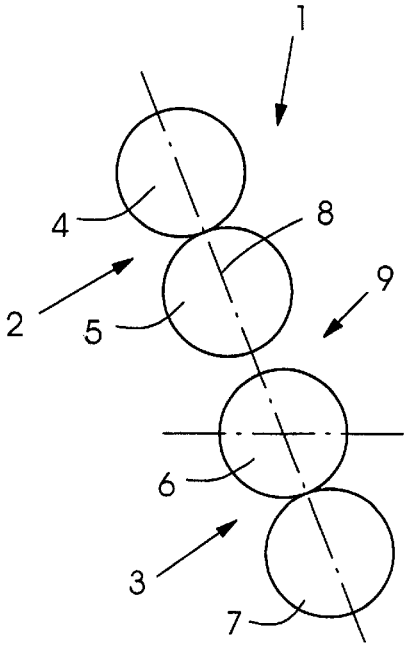
FIG. 3 is a view like those of FIGS. 1 and 2 wherein the printing unit cylinders are engaged pairwise with one another, leaving a through opening for a web of material between respective pairs of the printing unit cylinders.

In the operating phase shown in FIG. 3, printing unit cylinders positioned so as to engage one another pairwise in this manner are shown in the upper printing unit 2 and in the lower printing unit 3, respectively, with a through opening for the web of material being maintained. Pairwise mutual engagement of the printing unit cylinders 4 and 5, on the one hand, and 6 and 7, on the other hand, in the upper and the lower printing units 2 and 3, respectively, makes it possible to change the printing forms on the plate cylinders 4 and 7 in both printing units 2 and 3. By positioning the plate and the transfer cylinders 4 and 5, on the one hand, and 6 and 7, on the other hand, in the respective printing units 2 and 3 so that the respective cylinder pairs 4, 5, and 6, 7 are engaged with one another, considerably simplifies the mounting of the printing forms from an automatic plate changing device; in addition, a considerable amount of setup time is saved.

Figure 4:
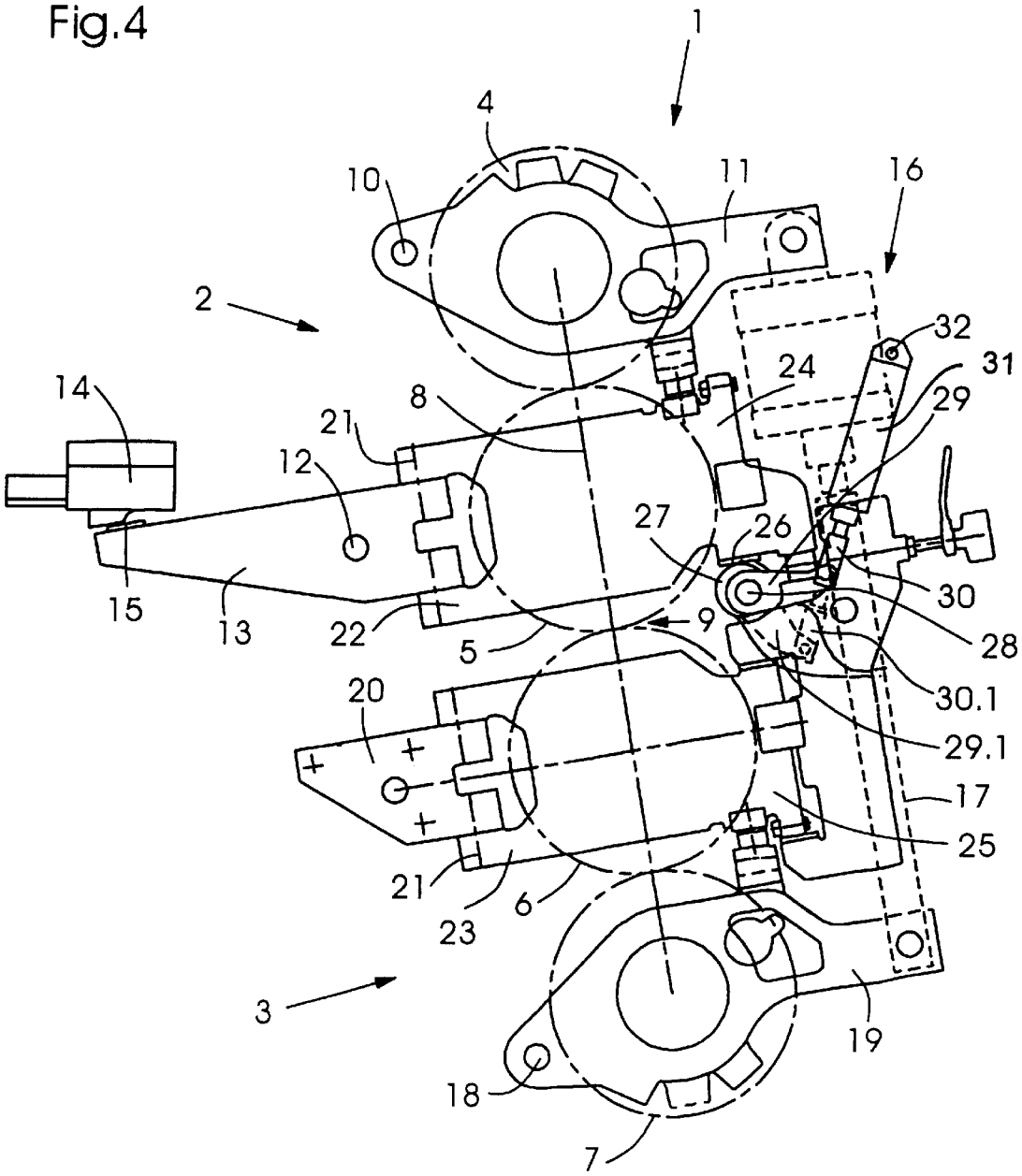
FIG. 4 is a side elevational view of the operator side of a printing entity with double printing units according to the invention.

FIG. 4 shows the operator side of a printing unit assembly or printing entity 1 having a double printing unit 2, 3 in accordance with the invention.

The printing unit assembly or printing entity 1, equipped with respective upper and lower printing units 2 and 3, shown in FIG. 4 as viewed from the operator side, includes disengageable printing-form cylinders 4 and 7, as well as two transfer cylinders 5 and 6, one of which is in a stationary position, and the other thereof is disposed so as to be disengageable therefrom. The illustrated transfer cylinders 5 and 6 are constructed without gaps or channels; a tubular or sleeve-shaped, uninterrupted rubber blanket is replaced after gates 22 and 23 have been opened, the gates 22 and 23 being, for this purpose, pivotable about a vertically oriented pivot axis 21. The gates 22 and 23 form a pivotable operating-side bearing support 40 for providing lateral access to the transfer cylinders 5 and 6.

In the view shown, the transfer cylinder 6, i.e., the rubber blanket cylinder of the lower printing unit 3 in the printing unit assembly or entity 1, is accommodated in a stationary bearing support 20. The lower plate cylinder 7 is pivotable about a rotational axis 18 by suitably bringing a pivot arm 19 into engagement.

In the upper printing unit 2, the upper plate cylinder 4 carried by the pivot arm 11 can be moved about a rotational axis 10. The upper transfer cylinder 5 is also pivotable about a rotational axis 12.

Adjusting or control units 16 and 17 are disposed on both sides of the side walls of the printing unit assembly or printing entity 1. The adjusting or control units 16 and 17 may be piston and cylinder units, which can be acted upon pneumatically or hydraulically. It would also be conceivable to use electromotive adjusting or control units. The adjusting or control unit 16 is pivotably connected to the upper pivot arm 11, while the corresponding adjusting or control rod 17 is connected to the lower pivot arm 19 of the lower plate cylinder 7. By acting upon the adjusting or control unit 16, there follows an immediate disengagement or throw-off of the upper and the lower plate cylinders 4 and 7 from the circumferential surfaces of the respective transfer cylinders 5 and 6.

Thereafter, the upper transfer cylinder 5, i.e., the rubber blanket cylinder, of the upper printing unit 2 can be disengaged or thrown-off from the rubber blanket cylinder 6 that is rotatably mounted in a stationary or fixed position. This is preferably effected via a separate eccentric adjusting or control unit, which includes an eccentric disk 27, a transmission lever 29, and an adjusting or control unit 31. A respective eccentric adjusting or control unit is provided on each of the side walls of the printing unit assembly or printing entity 1. After the disengagement or throw-off of the two plate cylinders 4 and 7 by the respective adjusting and control units 16 and 17, a disengagement or throw-off of the upper transfer cylinder 5 from the lower transfer cylinder 6 can be effected, so that a through opening for the web of material can be formed between the two printing units 2 and 3.

In an advantageous further embodiment, the adjusting or control unit 16, 17 and the eccentric adjusting or control unit 27, 29, 31 are activatable simultaneously, for example, by the interposition of a non-pressurized fluid, so that, in this manner, the lifting of the upper printing plate cylinder 4 and the lowering of the lower plate cylinder 7 can be effected by their own weight. The motion of the upper printing plate cylinder 4, due to the adjusting or control unit 16 thereof is accelerated even further by the activation of the eccentric adjusting and control unit 27, 29, 31, which further shortens the adjusting times in the printing unit; this can be significant, especially if an unforeseen event should suddenly occur.

After the adjusting or control unit 31 has been acted upon, a thrust member or abutment 32 of which is fixed on the side wall of the printing unit 11, the piston rod 30 travels into the extended position 30.1 thereof and moves the transmission or step-up lever 29 downwardly about the rotational axis 12 into a position 29.1 represented by broken lines.

As a result, an adjusting member or eccentric disk 27 rotates and, in turn, cooperates with a stop face 26 of a cylinder support 24. The cylinder support 24 is pivoted about the axis 12 due to the eccentricity of the disk 27. The stop face 26 may be formed of wear-resistant material or can be especially hardened. The pivoting of the cylinder support 24 about the rotational axis 12 causes a gap to be formed between the surfaces of the transfer cylinders 5 and 6, so that the web can remain between the printing units 2 and 3 of the printing unit assembly or printing entity 1.

The pivot arm 13 is secured by an additional holding unit 14, for example, when the rubber blanket sleeve on the upper transfer cylinder 5 is being replaced, and the additional holding unit 14 acts upon a stop face 15 provided on the pivot arm 13. This additional holding unit 14 can also be acted upon by a pressure medium, such as either compressed air or a hydraulic fluid, for example. Activation of this holding unit 14 is generally effected whenever the cylinder support 24 is in the disengaged position thereof, so that the rubber blanket sleeve can be changed by opening the side gate 22.

In the exemplary embodiment shown in FIG. 4, a cylinder support 25 is fixed on the side wall of the printing unit assembly or printing entity 1. A gate 23 is also provided on the stationary support 20, and is pivotable about a vertical pivot axis 21, to enable the rubber blanket sleeve to be changed by being pulled laterally away from the transfer cylinder 6.

Figure 5:
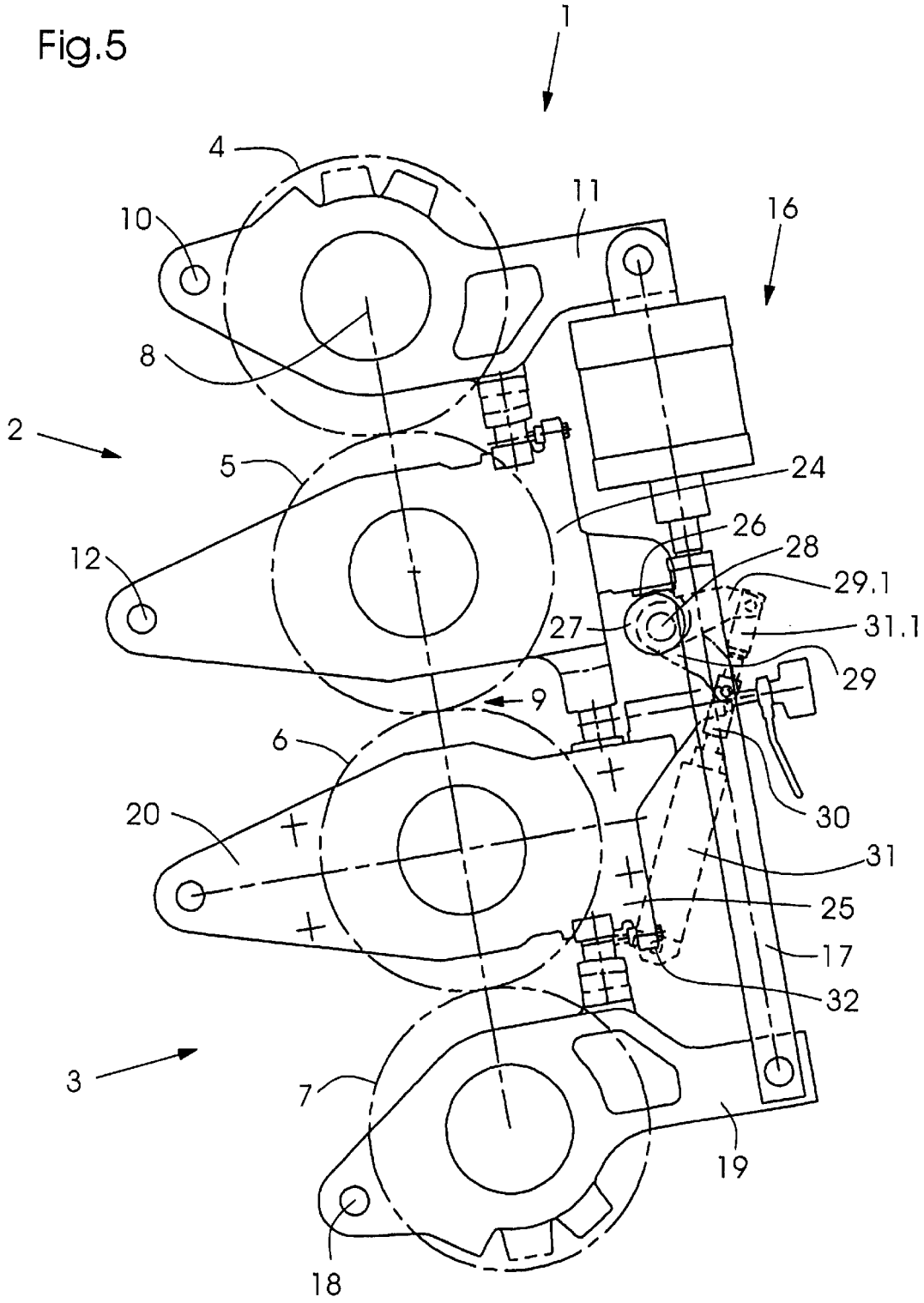
FIG. 5 is a side elevational view of the drive side of the printing units with a device for engaging and disengaging or throwing off the printing unit cylinders.

FIG. 5 shows the drive side of a printing unit assembly or printing entity 1 with an adjusting device according to the invention for engaging and disengaging or throwing-off the printing unit cylinders 4 to 7. In this view, in contrast with the view of FIG. 4, the abutment or thrust member 32 of the adjusting or control unit 31 of the eccentric control unit is secured on the side wall of the printing unit assembly or entity 1 in the region of the lower printing unit 3. In a non-illustrated modification of the device according to the invention, the adjusting or control unit 31 can also be provided in the upper printing unit 2.

Once again, the respective rotated and extended positions 29.1 and 31.1, respectively, of the transmission or step-up lever 29 and the piston rod 31 are shown. The transmission or step-up lever 29 assures a rotation of the eccentric shaft 28, so that the full eccentricity of the eccentric element 27 can be exploited in order to obtain a sufficiently wide gap for the web of material that remains between the two printing units 2 and 3.

The disengagement or throw-off of the two plate cylinders 4 and 7 from the circumferential surfaces of the respective transfer cylinders 5 and 6 is effected by the adjusting or control unit 16, 17; the pivot arms 11 of the upper plate cylinder 4 are raised, while the lower plate cylinder 7 drops downwardly of its own weight. Thereafter, the disengagement or throw-off of the upper transfer cylinder 5 from the lower transfer cylinder 6 is effected as described hereinabove, leading to the formation of a gap therebetween for the passage of the web of material. A paired disengagement or throw-off of the printing unit cylinders from one another (note FIG. 3) is then effected by slowly lowering the upper plate cylinder 4 onto the lower transfer cylinder 5, as a result of which the circumferential surfaces of these cylinders are in mutual contact. The lower plate cylinder 7 is raised by the adjusting or control unit 16 and brought into engagement with the circumferential surface of the stationarily mounted transfer cylinder 6. This takes place while the cylinder support 24 of the upper transfer cylinder 5, as a result of the eccentric control unit 27, 29, 31, remains in the position thereof wherein it is disengaged or thrown-off from the stationary transfer cylinder 6, the gap for the web of material being maintained. The pairwise or paired engagement of the printing unit cylinders with one another can be utilized for performing the changing of a printing form with the web of material remaining in the printing unit assembly or printing entity 1.

We claim:

1. A device for engaging and disengaging printing unit cylinders in a printing entity of a rotary printing press for printing a web of material, the printing entity including a lower and an upper printing unit, and one of the printing unit cylinders having a stationary mounting support in one of the printing units of the rotary printing press, comprising a cylinder support having a stop face, a first adjusting unit for adjusting a position of printing unit cylinders of the printing entity which are formed as printing form cylinders, and a second and eccentric adjusting unit for adjusting a position of one of two of the printing unit cylinders of the printing entity which are formed as transfer cylinders, said first adjusting unit and said eccentric adjusting unit cooperating so that the printing unit cylinders of each of the lower and the upper printing units, respectively, are in mutual engagement, while said transfer cylinders of the respective lower and upper printing units are disengaged from one another, the one printing unit cylinder having the stationary mounting support being one of the transfer cylinders, the other of the two transfer cylinders being disengageable by said eccentric adjusting unit from the stationarily supported transfer cylinder so as to form a through opening therebetween, said eccentric adjusting unit including an adjusting member, a transmission element, and a control unit, said control unit acting through said transmission element to actuate said adjusting member, said adjusting member acting against said stop face of said cylinder support.

2. The device according to claim 1, wherein the one printing unit cylinder having the stationary mounting support is the transfer cylinder in the lower printing unit.

3. The device according to claim 1, wherein said printing form cylinders of the upper and the lower printing units, respectively, are movable by said first adjusting unit away from said transfer cylinders of the printing units into a position wherein they are disengaged from one another.

4. The device according to claim 3, including a pressure medium for acting upon said first adjusting unit.

5. The device according to claim 4, wherein said pressure medium is compressed air.

6. The device according to claim 4, wherein said pressure medium is hydraulic fluid.

7. The device according to claim 3, including an electric motor for actuating said first adjusting unit.

8. The device according to claim 1, wherein the printing entity has a side wall, and said control unit has a thrust member carried by the side wall of the printing entity.

9. The device according to claim 1, wherein said control unit is responsive to a pneumatic force.

10. The device according to claim 1, wherein said control unit is responsive to a hydraulic force.

11. The device according to claim 1, including respective replaceable tubular rubber blanket sleeves provided on said transfer cylinders.

12. The device according to claim 1, including a pivotable operating-side bearing support for providing lateral access to said transfer cylinders.

13. The device according to claim 1, including a pivotable gate and an additional holding unit assigned to said disengageable transfer cylinder for holding the latter in a disengaged position when said gate is pivoted out of the way.

14. The device according to claim 1, wherein said first adjusting unit of said printing form cylinders, and said eccentric adjusting unit of said one transfer cylinder are conjointly actuatable.

* * * * *